US005921716A

United States Patent [19]

Wickberg et al.

[11] Patent Number: 5,921,716

[45] Date of Patent: Jul. 13, 1999

[54] APPARATUS AND METHOD FOR FORMING A BARRIER WALL

[76] Inventors: Norman Wickberg, 27 Wardell Cir., Oceanport, N.J. 07757; Carl DeGroote, 14 Windsor Ter., Freehold, N.J. 07728

[21] Appl. No.: 08/588,341

[22] Filed: Jan. 18, 1996

[51] Int. Cl.[6] ..... E02D 5/03

[52] U.S. Cl. ..... 405/278; 52/590.2; 52/592.3

[58] Field of Search ..... 405/278, 281; 52/590.2, 590.3, 592.2, 592.3, 741.11, 741.13

[56] References Cited

U.S. PATENT DOCUMENTS

| | | | |
|---|---|---|---|
| 3,302,412 | 2/1967 | Hunsucker | 405/278 |
| 3,333,431 | 8/1967 | Dougherty | 405/278 |
| 3,492,826 | 2/1970 | Horstketter et al. | 405/281 |
| 4,419,030 | 12/1983 | Burkemper | 405/278 |
| 4,863,315 | 9/1989 | Wickberg | 405/281 |

FOREIGN PATENT DOCUMENTS

| | | | |
|---|---|---|---|
| 376087 | 7/1932 | United Kingdom | 405/278 |

*Primary Examiner*—Michael Safavi
*Attorney, Agent, or Firm*—Thomason & Moser

[57] ABSTRACT

A method and apparatus forming a subterranean barrier wall that is substantially impervious to liquids. The barrier wall and method of forming the same comprises interlocking a plurality of sheet piles. Each sheet pile has interlocking edges that form a sealed joint. The interlocking edges consist of two semi-circular portions, a first semi-circular groove and a first radial edge, and a quarter-circular part, a second radial edge. Interlocking the sheet piles by a first inner locking edge, a second interlocking edge and an outer locking edge at the interlocking edges forms a barrier wall forming a substantially moisture-impervious seal.

13 Claims, 5 Drawing Sheets

APPARATUS AND METHOD FOR FORMING A BARRIER WALL

SPECIFICATION

1. Field of the Invention

The present invention relates to methods and apparatus for forming a subterranean barrier wall that is substantially impervious to liquids, such as groundwater. More particularly, the invention relates to joining structural panels to form a substantially moisture-impervious seal.

BACKGROUND OF THE INVENTION

In the art of earth work, various means have been used to contain, divert, intercept and control subsurface flows of water. The prior art methods utilize soil cements, mortars, grouting, concrete and the like to construct subsurface walls. These methods and materials have the drawbacks of difficult excavation and expensive materials being used in a dig and pour construction of the wall below grade. Also, the substantial rigidity of the finished wall can lead to problems with cracks and leaks caused by settling, subsidence, as well as unequal hydraulic pressures upon opposite sides, or even below, these walls. Also, non-structural members and sheeting have been used for subsurface barrier walls, for example, by rolling the material into a pre-dug trench using the methods and apparatus in U.S. Pat. No. 5,320,454. Still, excavation before installation of the wall is necessary. Also, the non-structural barriers cannot withstand vertical or full horizontal loading. All the drawbacks of these prior art methods and apparatus are accompanied with the difficulties of repair or maintenance to the wall, because a second excavation is required to remove, replace or repair any portion of the wall. The prior art barrier walls typically require welding of the panel or sheet to a connector means. Thus, a need exists for a method and means for forming a subterranean wall that seals off aqueous flows and which can be installed, removed or replaced without expensive excavation.

The prior art discloses locking edges that join panels for use as bulkheads, however, in that and similar applications, seepage of liquids through the lock is acceptable, as a means of equalizing the liquid pressure on either side of the bulkhead. These prior art edges joined the members, but within the joint there was limited surface contact between the edges, and so seepage could occur. The usefulness of increasing the surface contact area between the interlocking edges to form a more effective moisture barrier was recited in U.S. Pat. No. 5,320,454, which used a plurality of interlocking slots and channels. A need exists for a simpler and more efficient means of increasing surface contact and of improving the seal in the interlock between the members that form the barrier wall. To fulfill these needs and to overcome the limitations of the prior art methods and apparatus, the invention described and claimed here provides improved interlocking edges, and also, a means of sealing the interlock between the sheet piles, so that persons skilled in the art can form a subterranean wall that is substantially impervious to liquid flows.

SUMMARY OF THE INVENTION

The object of the present invention is to provide sheet piles with interlocking edges that form a sealed joint, which is useful for a barrier that is substantially impervious to liquids. The panel has edges that consist of two semi-circular portions and a quarter-circular part, all of which have arcs of substantially equal radius. Additionally, the locking edges may have crush seals or the edges may be adapted to accept sealants to increase the imperviousness of the joint that locks the panels.

DESCRIPTION OF THE PREFERRED EMBODIMENTS

Figure 1:
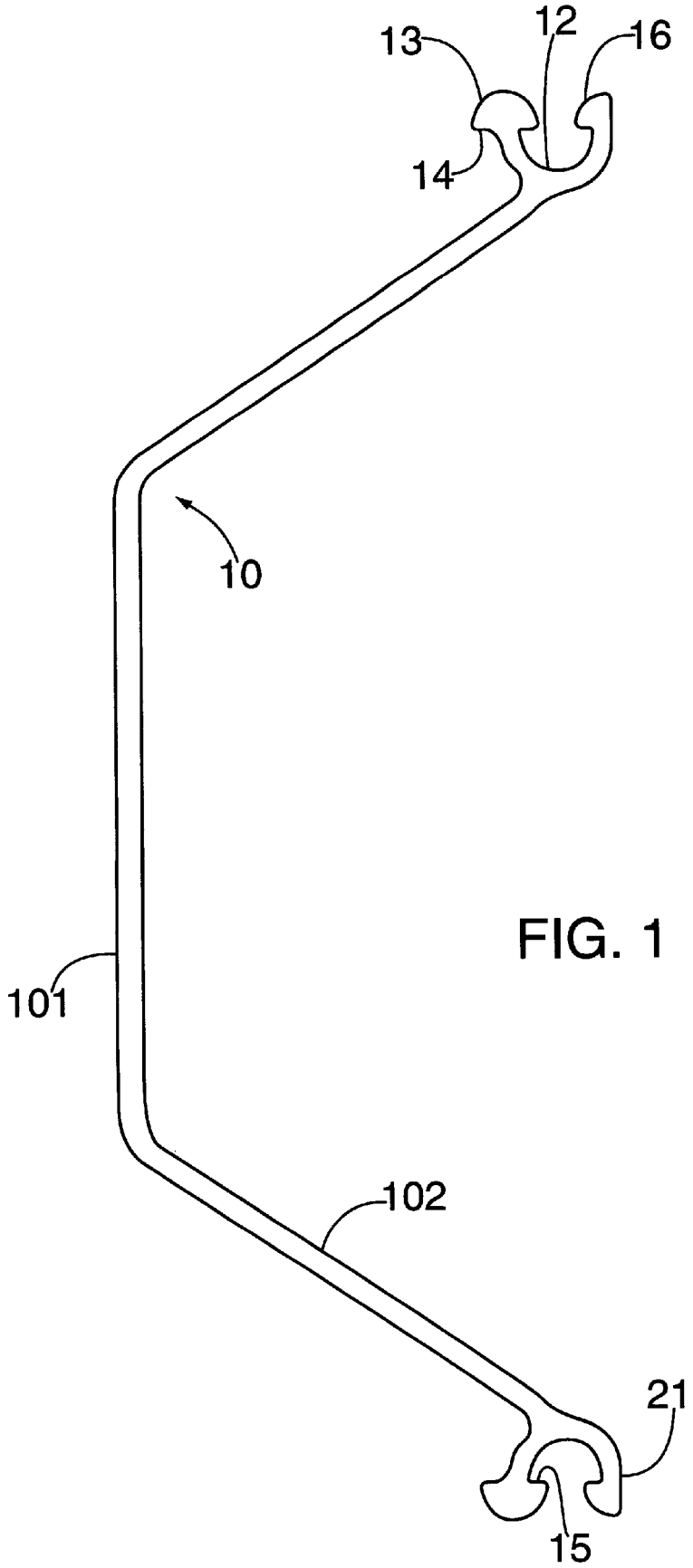
FIG. 1 is a cross-sectional view of the sheet pile, its side walls and edges, including the semi-circular opening, semi-circular radial edge portion and the quarter-circular radial edge and locking edges.

FIG. 1 depicts in cross-section the rectilinear edges along the side of a sheet pile member 10, formed typically of a material resistant to liquids and to chemical degradation. The sheet pile member may be formed as one piece including the edges, or the pile may be formed and then the edge portions joined to it. The edges typically have a substantially uniform thickness, except for those portions of the edges that are semi-circular and quarter-circular. The edges that are semi-circular and quarter circular are sized both to balance the mass at the extremities of the lock and to provide strength.

The first semi-circular edge 12 is, in cross-sectional view, a mushroom shaped opening or groove 11, and the second semi-circular edge 13 is a solid, bullet-shaped radial edge that fits within the semi-circular opening of another flexible member. The quarter circular edge is 16.

Figure 2:
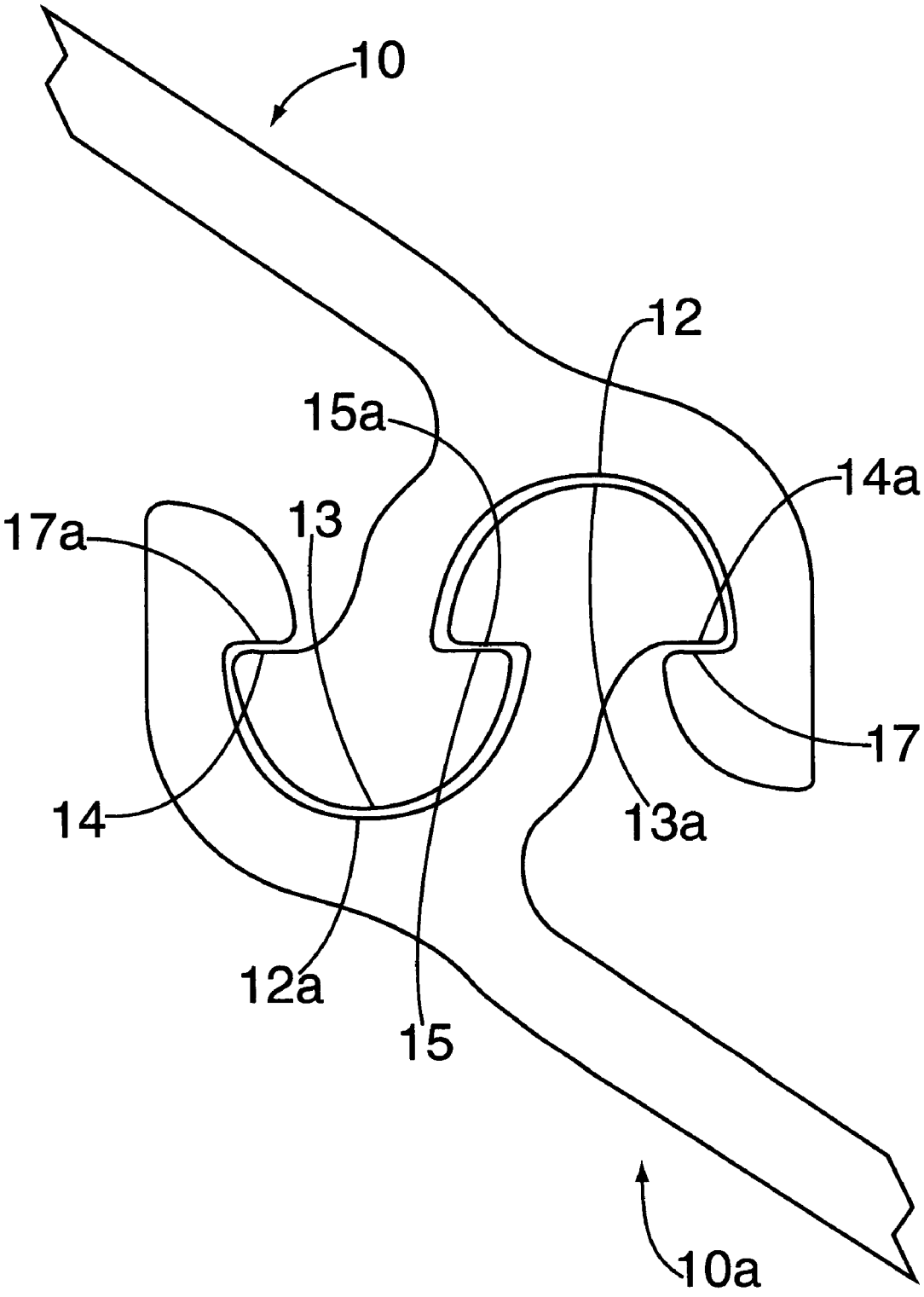
FIG. 2 is a cross-sectional view of the semi-circular edges of two members interlocked to joined to form a seal.

The radii of these circular portions is substantially the same. The radius of that semi-circular opening are slightly greater than that of the semi-circular edge portion, so that when joined the radial edges of two members form a seal along the mated semi-circular edges 12 and 13*a*, as depicted in FIG. 2. The space, depicted in the figures, between the radial and locking edges is widened to show the invention, however, in its preferred form, the edges are in contact. Sealing force is maintained by the locking edges on pile 10, e.g., 14, 15 and 17 being sealed against the locking edges on pile 10*a* in FIG. 2. Specifically mated are locking edges 14 with 17*a*, 15 with 15*a*, and 17 with 14*a* in FIG. 2. When the edges are joined, as in FIG. 2, the seal is less transmissive to liquid flows because of the increased surface contact between the complementary rounded edges 12 and 13*a*, and 12*a* and 13, and because the circumferential distances along the edges lengthens the travel path of any liquid that comes in contact with the barrier wall.

Figure 3:
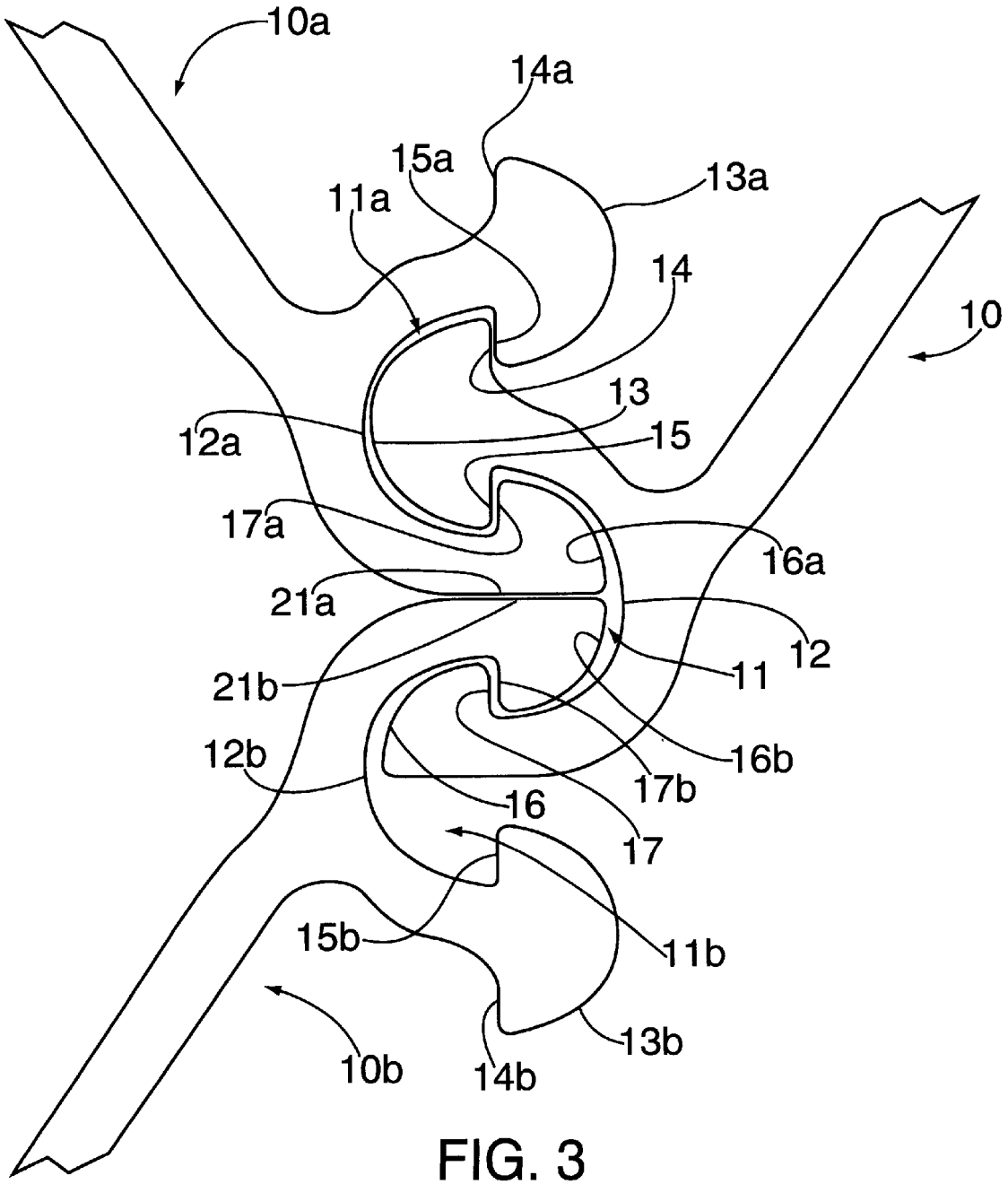
FIG. 3 is a cross-sectional view of the quarter-circular edges of two members forming a sealed connection within the groove of a third member that is locked to those two members.

The quarter-circular edge 16 substantially equals in size and shape to one-half of the semi-circular edge portion, that is, as depicted in cross-section view FIG. 1, bisecting the semi-circular edge portion 13 would approximately define the quarter-circular edge portion 16. Thus, as depicted in FIG. 3, the quarter-circular edges 16*a* and 16*b* of two members 10*a* and 10*b* will provide a sealed connection when placed within the semi-circular opening 11 and against edge 12 of first sheet pile 10, by forming a seal along the mated surfaces of the semi-circular and the quarter-circular edges.

In a preferred embodiment, the apparatus for joining sheet piles depicted in cross-section in FIG. 1 would have the following features and dimensions. The sheet pile 10 has a substantially uniform thickness t, except for the semi-circular and quarter-circular radial edges that are dimensioned along the rectilinear side of the sheet pile 10 as follows. The pile depicted in cross-section has a groove 11 along the sides of the rectilinear dimension of the member 10, and groove 11 has a radius R2 that defines a semi-circular edge 12 to the groove. At one side of the groove is a mushroom-shaped edge or rib 13 formed with a radius R1, described as a first radial edge. In the preferred embodiment R2 is slightly greater than R1, more specifically R2 equals 0.618" and R1 equals 0.578", that is R2 equals R1 plus 0.040". At the inner and outer terminus of the radius of semi-circular edge 13 are relatively straight locking edges 14 and 15 which have a dimension of d1. The straight inner locking edge 14 is, in length, the distance between the circumferential arc or secant of first and second semi-circular edges 12 and 13, and d1 is less than R1. At the side of the groove 11 opposite first radial edge and at the terminus of the radius of radial edge 12 is a quarter-circular radial edge 16 described as the second radial edge which is formed with the radius R3, which in the preferred embodiment is 0.598". In this embodiment, the opening between edges 13 and 16 is 0.636". At the terminus of the radius of the quarter-circular edge 16 is a relatively straight second inner locking edge 17 that extends to the terminus of the radius of groove 11 has the dimension of d1. In the preferred embodiment, inner locking edges 14 and 17 and outer locking edge 15 are straight, but the terminus areas 18, 19 and 20 are rounded between the straight edges and the semi-circular or the quarter-circular edges. Also, in the preferred embodiment, the quarter-circular radial edge has a side portion 21 that is relatively straight.

Figure 4:
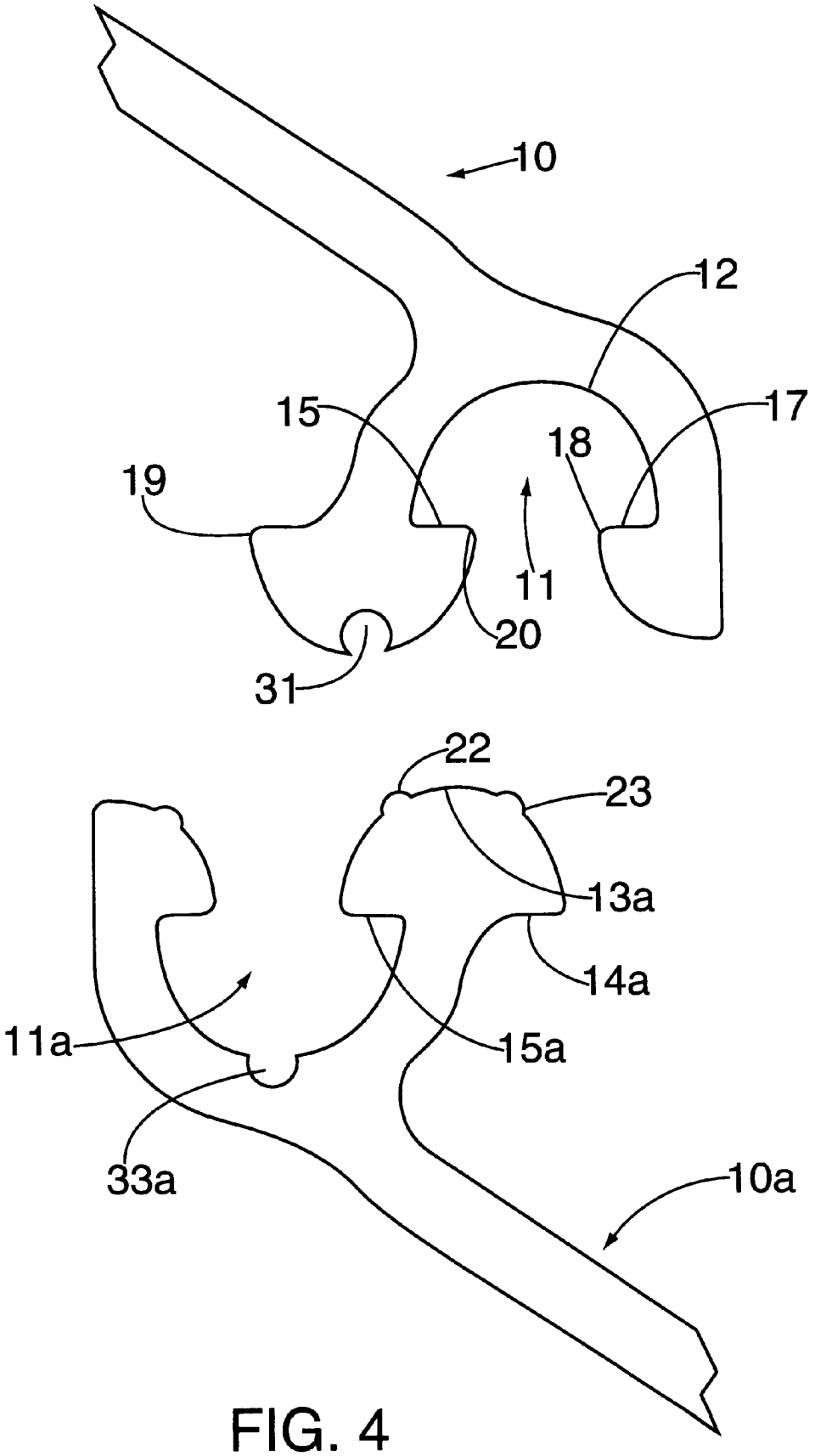
FIG. 4 is a cross-sectional view of the edges of the member including crush seals and including a channel to accept sealant.

FIG. 4 depicts another embodiment of the sealed joint. Along the semi-circular edge 13 are at least one seal, shown as seals 22 and 23. These seals are ridges formed along the length of the edge 13. The seals crush or deform when the edge 13 of a first sheet pile 10 is inserted in the groove 11 of a second sheet pile 10*a*. The compressed seal 22 increases the effectiveness of the moisture barrier formed between edge 12 and edge 13, as depicted in FIG. 4. Also, seal 22 displaces additional sealing force between locking edges 14 and 17, and edges 15 on pile 10 and 15*a* on pile 10*a*.

The cross-section view in FIG. 4 depicts a groove 31 formed in the semi-circular edge 13 on pile 10. The keyway or groove 31 is formed along the length of the semi-circular edge 13. Opposite that semi-circular edge there is formed in edge 12*a* a receiving channel 33*a* on pile 10*a* that in cross-section appears as a concave socket.

The keyway 31 receives sealing compound and additionally, that may be placed in channel 33*a* to increase the impermeability and strength of the joint between the interlocked sheet piles. In another embodiment, the keyway 31 receives swellable material which expands upon extended exposure to moisture. The art discloses swellable materials that are hydrophilic. The keyway 31 accepts the sealant or swellable material as one sheet pile is fitted within the interlock edge of a second pile. The swellable material on the sealant fills any gap in the interlock with a seal that is impervious to liquid. FIG. 4 also depicts raised ridges formed upon 13*a* along the full length of edge 13, which extends along the rectilinear edge of 10*a*. These ridges may be solid or serrated, but in either embodiment, the edges act as crush seals to tighten the seal between 12 and 13*a*, and to impose force against the locking edges.

The semi-circular, quarter-circular and locking edges on the sheet pile 10 are dimensioned to be mateable. These edges, when formed along the side length of the sheet pile, that is along the rectilinear dimension of the sheet pile, can be placed into mated configuration to form a substantially impervious seal between two or more sheet piles. The semi-circular edge 13 of sheet pile 10 in FIG. 2 is mated within the complementary semi-circular shaped groove on pile 10*a*, and in corresponding manner, the rounded semi-circular portion 13*a* on pile 10*a* fits against semi-circular edge 12 on pile 10, in a sealed connection. This sealed arrangement is repeated typically between the edges on the opposite rectilinear dimension of sheet pile 10*a* in FIG. 2 with a third sheet pile not shown. A plurality of sheet piles joined as in FIG. 2 would provide a barrier wall that is substantially impervious to liquid flows. By reference to the sheet pile in FIG. 1 when placed in mated arrangement with a second pile, as in FIG. 2, would provide a barrier wall, which in cross-section would be arranged, such that sheet pile side wall 102, shown on FIG. 1, would be in general alignment with, or on parallel line with, the corresponding side wall on pile 10*a* in FIG. 2. The center wall 101 on pile 10 in FIG. 1 would be generally parallel to the corresponding side wall, not shown on the second sheet pile in FIG. 2. The piles typically are formed of a material that has resilient and has some capacity to bend along the cross-sectioned walls depicted in FIG. 1. When so made, the barrier wall formed by a series of piles joined at their edges in FIG. 2 may be a straight wall or a wall that can curve to the degree of bending permitted by the material of which the piles are formed. The sealed connection as in FIG. 2 does not use a glue or joining agent, rather the seal is achieved by the surface contact between the complementary shaped semi-circular edges, and the locking between the straight edges 17*a* with 14, 15*a* with 15 and 14*a* with 17.

The mateable edges formed of complementary radii enable the piles to be joined in several ways that each provide a sealed connection. While the edges are described herein in terms of the preferred embodiments of radii and circular edges, the teaching is that these edges are complimentary in shape, and thus, may be out of round or elliptical or curved or secant or arc lines. Also, the locking edges are described herein as straight lines, but these are complementary or mateable edges that serve to lock and hold the edges of the piles in a joined connection. FIG. 3 depicts the edges of three sheet piles locked together. Sheet pile 10 is locked to pile 10*a* by semi-circular edge 13 being positioned within the semi-circular opening formed on pile 10*a* along edge 12*a*. The semi-circular groove on pile 10 formed along edge 12 receives the quarter-circular edges 16*a* and 16*b* of piles 10*a* and 10*b*. Those edges of piles 10*a* and 10*b* are positioned with straight edges 21*a* and 21*b* in contact, so that the two quarter-circular edges together mate with the semi-circular edge 12 in a manner similar to the way the semi-circular portion 13 mates with edge 12*a*. The configuration in FIG. 3 forms a wall of sheet piles that functions as a barrier to liquid flows, and that provides an area for a structured member to be included as part of that wall. In FIG. 3, piles 10*a* and 10*b* are placed in opposing arrangement, such that by reference to FIG. 1, their center walls 101, not shown, would be generally parallel, as well as the side wall 102 on pile 10*a* would be substantially parallel to side wall 102 on pile 10*b*, that is obverse parallel. Thus, piles 10*a* and 10*b* in FIG. 3 provide a box within which a structural post can be placed, or alternatively, concrete may be poured therein, which would provide support for the piles joined into a wall. Such box also can hold utilities, including pipes, wires or test equipment. Typically, the piles 10*a* and 10*b* joined to provide a box are connected to a single pile 10, as in FIG. 3, which when positioned and driven in the ground, would be joined further to a plurality of single piles, not shown in FIG. 3. That provides a structural point, connected then to a series of piles forming the barrier wall, then joined to another pair of piles joined to form a box, and so forth. The single piles may be joined as a double lock in FIG. 2, or in the single lock arrangement shown in FIG. 5.

Figure 5:
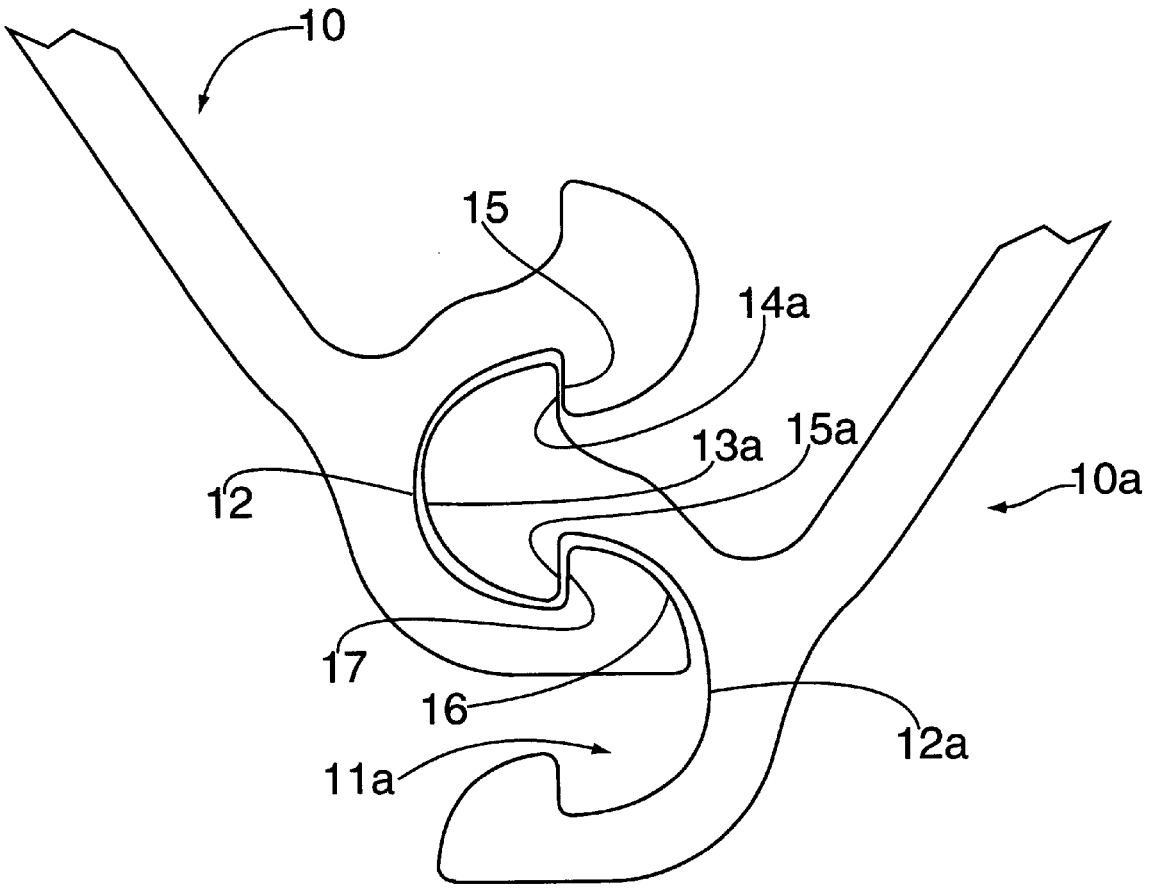
FIG. 5 is a cross-sectional view of the first radial edge of a sheet pile placed in a single lock configuration within the semi-circular groove of a second sheet pile.

The mated arrangement of piles 10 and 10*a* in FIG. 5 is a single lock with the piles positioned basically the same as piles 10*a* and 10 in FIG. 3. In FIG. 5, sheet pile 10*a* is locked to pile 10 by semi-circular edge 13*a* being positioned within the semi-circular opening formed on pile 10 along edge 12. The semi-circular groove on pile 10*a* formed along edge 12*a* receives the quarter-circular edge 16 of piles 10. Those edges of piles 10 and 10*a* are positioned so that a single locked joint is formed. The configuration in FIG. 5 forms a wall of sheet piles that functions as a barrier wall to liquid flows, but this single lock is more permeable to liquid flows than the double lock shown in FIG. 2. A subterranean barrier wall formed as in FIG. 5 has piles 10 and 10*a* are driven in the ground in repeating arrangement, such that by reference to FIG. 1, their center walls 101, would be generally along the same line, and their side walls 102 would be on lines intersecting at the joint.

As can be understood by those skilled in the art, the piles can be joined to form a wall using all the configurations shown in FIGS. 2, 3 and 5 at various points in the wall. The adaptable shapes of the part-circular and straight edges provide a useful means to form barrier walls along straight and angled lines, as well as around the perimeter of an area. In this way, the sheet piles can form walls to contain, or to divert, or to channel or to intercept, liquid flows typically in soil media or in sands.

The method of forming an impermeable wall of the interlocking sheet piles involves the following steps. The first pile 10 is raised and positioned at a point along the perimeter to be enclosed by the barrier wall, then driven into the ground using a suitable pile-driving apparatus. After driving the first pile 10, a second pile 10*a* is raised and positioned alongside where the first pile 10 was driven. That second pile 10*a*, specifically semi-circular edge 13*a* of pile 10*a*, is aligned to be received alongside edge 12 that is inserted within groove 11 of pile 10. In this manner, the second pile in driven to form a single lock between edge 13*a* and 12*a*, within groove 11, and where the inner locking edges 15 and 17 on the first pile 10 are seated against locking edges 14*a* and 15*a* on the second pile 10*a*, as in FIG. 5. Edge 16 is within groove 11*a* and in substantial contact with 12*a*. These steps are repeated until a subterranean barrier wall along the desired course or perimeter is formed.

In a second embodiment, FIG. 2, after driving the first pile 10, the edge of second pile 10*a* is positioned above the edge of pile 10 so that the semi-circular edge 13 on pile 10 and radial edge 13*a* on pile 10*a* is aligned to be received in each groove 11 of the other pile, to form a double lock, as in FIG. 2. When the second pile is driven into place with the first pile, as in FIG. 2, the piles are locked by contact between locking edges 17*a* and 14, and 14*a* and 17, and 15*a* and 15. The piles are sealed along the radii of edges 12 and 13*a*, and 13 and 12*a* to form a subterranean wall.

A further embodiment of the method as in FIG. 3 is the first pile 10 is raised and positioned at a point along the perimeter to be enclosed by the wall, then driven into the ground using a suitable pile-driving apparatus. After driving the first pile 10, a second pile 10*a* and a third pile 10*b* are raised and their edges positioned alongside where the first pile 10 was driven, at a point where the quarter-circular edges 16*a* and 16*b* of piles 10*a* and 10*b* are aligned, so there is parallel alignment between straight edges 21*a* and 21*b*, and then the edge of the second and third piles are inserted into groove 11 of pile 10 to form a joint between pile 10 and piles 10*a* and 10*b*, as in FIG. 3. In the FIG. 3 configuration, piles 10*a* and 10*b* are locked to pile 10 by mating along locking edges 15*a* and 14, 15 and 17*a*, and 17 and 17*b*. The joint is sealed along the surface contact points of radii 12*a* and 16, 16*a* and 12, and 16*b* and 12, and 12*b* with 16.

Persons skilled in the art can utilize combinations of single locks, single to double locks, and double locks in one course or wall of panels. For example, two piles can be driven in obverse parallel relation and joined, as in FIG. 3, to a single pile, which can be joined to a second pile and to a plurality of sheet piles in any of the arrangements described herein. Further, the space between the piles in obverse relation can house a conventional piling or can be filled with structural material such as cement. The method of forming a wall of panels of the embodiment depicted in FIG. 4 is done using the same steps, with one added step. Sealant is introduced into the keyway 31 in the interlocking edge, typically by pressure, or by rolling swellable material into the keyway as the pile is driven. These steps are continued with a plurality of sheet piles to form and seal an interlocking wall of sheet piles.

The invention disclosed herein has been described in detail with particular reference to the embodiments illustrated herein, and it will be understood by those skilled in the art that many variations and modifications can be made without departing from the spirit of the invention described above and claimed as follows:

What is claimed is:

1. A sheet pile comprising

A semi-circular groove along a rectilinear dimension of a first sheet pile, said groove in cross-section having a radius that defines a semi-circle, A first radial edge at one side of said groove, extending along said rectilinear dimension of said first pile, said first edge in cross-section having a radius that defines a semi-circle smaller than that of said semi-circular groove, A first inner locking edge beginning at the terminus of the radius of said first radial edge and extending to the terminus of the radius of said semi-circular groove, A second radial edge extending along the side of said groove opposite said first radial edge, said second radial edge in cross-section having a radius substantially equal to that of said first radial edge portion that defines a quarter-circle, A second inner locking edge beginning at the terminus of the radius of said second radial edge and extending to the terminus of the radius of said semi-circular groove, An outer locking edge, beginning at the terminus of the first radial edge opposite said first inner locking edge and extending to the rectilinear dimension of said first sheet.

2. A sheet pile as in claim 1 further comprising

At least one raised area upon said first radial edge and extending along said rectilinear dimension of said sheet pile.

3. A sheet pile as in claim 1 further comprising

At least one raised area upon said first radial edge and extending along said rectilinear dimension of said sheet pile;

A raised area upon said second radial edge and extending along said rectilinear dimension of said sheet pile.

4. A sheet pile as in claim 1, further comprising,

A second sheet pile,

A first radial edge along a rectilinear dimension of a second sheet pile, said first radial edge in cross-section having a radius that defines a semi-circle, said first radial edge of said second sheet pile being placed within said semi-circular groove of said first sheet pile, A semi-circular groove along said rectilinear dimension of said second sheet pile, said groove in cross-section having a radius that defines a semi-circle, said first radial edge of said first sheet pile being placed within said semi-circular groove of said second sheet pile, A first inner locking edge on said second sheet pile beginning at the terminus of the radius of said first radial edge and extending to the terminus of radius of said semi-circular groove, said first inner locking edge on said second sheet pile seated against said first inner locking edge on said first sheet pile, A second radial edge on said second sheet pile extending along the side of said groove opposite said first radial edge on said second sheet pile, said second radial edge in cross-section having a radius substantially equal to that of said first edge portion that defines a quarter-circle, A second inner locking edge on said second sheet pile beginning at the terminus of the radius of said second radial edge and extending to the terminus of the radius of said semi-circular groove on said second sheet pile, said second inner locking edge sealed against said outer locking edge on said first sheet pile, An outer locking edge on said second sheet pile beginning at the terminus of the first radial edge on said pile opposite said first inner locking edge on said second sheet pile and extending to the rectilinear dimension of said second sheet pile, said outer locking edge seated against said second inner locking edge on said first sheet pile.

5. A sheet pile as in claim 1, further comprising,

A second sheet pile,

A first radial edge along a rectilinear dimension of a second sheet pile, said first radial edge in cross-section having a radius that defines a semi-circle, said first radial edge of said second sheet pile being placed within said semi-circular groove of said first sheet pile, A semi-circular groove along said rectilinear dimension of said second sheet pile, said groove in cross-section having a radius that defines a semi-circle, said second radial edge of said first sheet pile being placed within said semi-circular groove of said second sheet pile, A first inner locking edge on said second sheet pile beginning at the terminus of the radius of said first radial edge and extending to the terminus of the radius of said semi-circular groove, said first inner locking edge seated against said second inner locking edge on said first sheet pile, A second radial edge on said second sheet pile extending along the side of said groove opposite said first radial edge on said second sheet pile, said second radial edge in cross-section having a radius substantially equal to that of said first edge portion that defines a quarter-circle, A second inner locking edge on said second sheet pile beginning at the terminus of the radius of said second radial edge and extending to the terminus of the radius of said semi-circular groove on said second sheet pile, An outer locking edge on said second sheet pile beginning at the terminus of the first radial edge on said pile opposite said first inner locking edge on said second sheet pile and extending to the rectilinear dimension of said second sheet pile, said outer locking edge seated against said first inner locking edge on said first sheet pile, A third sheet pile having a first radial edge along a rectilinear dimension of said third sheet pile, said first radial edge on said third sheet pile in cross-section having a radius that defines a semi-circle, A semi-circular groove along said rectilinear dimension of said third sheet pile, said groove in cross-section having a radius that defines a semi-circle, said second radial edge of said second sheet pile being placed within said semi-circular groove of said third sheet pile, A first inner locking edge on said third sheet pile beginning at the terminus of the radius of said first radial edge and extending to the terminus of radius of said semi-circular groove, A second radial edge on said third sheet pile extending along the side of said groove opposite said first radial edge on said third sheet pile, said second radial edge in cross-section having a radius substantially equal to that of said first edge portion that defines a quarter-circle, said second radial edge being placed within said semi-circular groove on said second sheet pile, A second inner locking edge on said third sheet pile beginning at the terminus of the radius of said second radial edge and extending to the terminus of the radius of said semi-circular groove on said third sheet pile, said second inner locking edge sealed against said second inner locking edge on said second sheet pile, An outer locking edge on said third sheet pile beginning at the terminus of the first radial edge on said pile opposite said first inner locking edge on said third sheet pile and extending to the rectilinear dimension of said third sheet pile.

6. A sheet pile as in claim 1, further comprising,

A second sheet pile,

A first radial edge along a rectilinear dimension of a second sheet pile, said first radial edge in cross-section having a radius that defines a semi-circle, said first radial edge of said second sheet pile being placed within said semi-circular groove of said first sheet pile, A semi-circular groove along said rectilinear dimension of said second sheet pile, said groove in cross-section having a radius that defines a semi-circle, said second radial edge of said first sheet pile being placed within said semi-circular groove of said second sheet pile, A first inner locking edge on said second sheet pile beginning at the terminus of the radius of said first radial edge and extending to the terminus of the radius of said semi-circular groove, said first inner locking edge seated against said second inner locking edge on said first sheet pile, An outer locking edge on said second sheet pile beginning at the terminus of the first radial edge on said pile opposite said first inner locking edge on said second sheet pile and extending to the rectilinear dimension of said second sheet pile, said outer locking edge seated against said first inner locking edge on said first sheet pile.

7. A sheet pile as in claim 1, further comprising a keyway grooved within and along the length of said first radial edge, said keyway for receiving swellable material.

8. A sheet pile as in claim 1, further comprising a keyway grooved within and along the length of said first radial edge, said keyway for receiving sealant.

9. A method of forming a subterranean barrier wall of a plurality of sheet piles, wherein each sheet pile has rectilinear dimensions, opposite ends, and edges along each rectilinear dimension, and has a semi-circular groove along each rectilinear dimension, said groove in cross-section having a radius that defines a semi-circle, and has a first radial edge at one side of said groove, extending along each rectilinear dimension, said first edge in cross-section having a radius that defines a semi-circle smaller than that of said semi-circular groove, and has a first inner locking edge beginning at the terminus of the radius of said first radial edge and extending to the terminus of the radius of said semi-circular groove, and has a second radial edge extending along the side of said groove opposite said first radial edge, said second radial edge in cross-section having a radius substantially equal to that of said first radial edge portion that defines a quarter-circle, and has a second inner locking edge beginning at the terminus of the radius of said second radial edge and extending to the terminus of the radius of said semi-circular groove, and has an outer locking edge, beginning at the terminus of the first radial edge opposite said first inner locking edge and extending to the rectilinear dimension of the sheet pile, said method comprising:

(a) positioning a first sheet pile of said plurality of sheet piles for driving into the ground;

(b) driving the end of said first pile into the ground;

(c) positioning a second said pile for driving into the ground alongside said first pile so that said first radial edge of said second sheet pile will be inserted into said semi-circular groove of said first sheet pile, and said first radial edge of said first sheet pile will be inserted into said semi-circular groove of said second sheet pile, (d) driving said positioned second pile into the ground in interlocking connection with said first pile, (e) positioning a third said pile for driving into the ground alongside said second pile so that said first radial edge of said third sheet pile will be inserted into said semi-circular groove of said second sheet pile, and said first radial edge of said second sheet pile will be inserted into said semi-circular groove of said third sheet pile, (f) driving said positioned third pile into the ground in interlocking connection with said second pile, (g) driving a plurality of said piles into the ground in interlocking position to form a subterranean wall.

10. The method of claim 9 further comprising the step of:

(h) selectively joining to a single sheet pile a pair of said piles positioned in obverse parallel relation to form a box for providing additional support along said wall.

11. The method of forming a subterranean barrier wall of a plurality of sheet piles, as in claim 9, wherein each sheet pile further has a keyway grooved within and along the length of said first radial edge, said keyway for receiving swellable material to seal the wall, said method further comprising:

(a) placing swellable material or sealant in said keyway of each said sheet pile as it is driven into the ground.

(b) driving said third pile into interlocking position with said second pile, (c) driving a plurality of said piles into interlocking position to form a subterranean wall.

12. A method of forming a subterranean barrier wall of a plurality of sheet piles, wherein each sheet pile has a rectilinear dimension, opposite ends, and edges along the rectilinear dimension, and has a semi-circular groove along each rectilinear dimension, said groove in cross-section having a radius that defines a semi-circle, and has a first radial edge at one side of said groove, extending along each rectilinear dimension, said first edge in cross-section having a radius that defines a semi-circle smaller than that of said semi-circular groove, and has a first inner locking edge beginning at the terminus of the radius of said first radial edge and extending to the terminus of the radius of said semi-circular groove, and has a second radial edge extending along the side of said groove opposite said first radial edge, said second radial edge in cross-section having a radius substantially equal to that of said first radial edge portion that defines a quarter-circle, and has a second inner locking edge beginning at the terminus of the radius of said second radial edge and extending to the terminus of the radius of said semi-circular groove, and has an outer locking edge, beginning at the terminus of the first radial edge opposite said first inner locking edge and extending to the rectilinear dimension of the sheet pile, said method comprising:

(a) positioning a first sheet pile of said plurality of sheet piles for driving into the ground;

(b) driving the end of said first pile into the ground;

(c) positioning a second said pile for driving into the ground alongside said first pile so that said second radial edge of said second sheet pile can be inserted into said semi-circular groove of said first sheet pile, and said first radial edge of said first sheet pile will be inserted into said semi-circular groove of said second sheet pile, (d) driving said positioned second pile into the ground in interlocking connection with said first pile, (e) driving a plurality of said piles into the ground in interlocking position to form a subterranean wall.

13. The method of forming a subterranean barrier wall of a plurality of sheet piles, as in claim 12, said method further comprising:

(f) positioning a third said pile for driving into the ground alongside said second pile so that said second radial edge of said third sheet pile will be inserted into said semi-circular groove of said first sheet pile, and said second radial edge of said first sheet pile will be inserted into said semi-circular groove of said third sheet pile, (g) driving said positioned third pile into the ground in interlocking connection with said first and second piles, and with said second and third piles in obverse parallel relation, (h) driving a plurality of said piles into the ground in interlocking position to form a subterranean wall.

* * * * *